US006001549A

United States Patent [19]

Nair et al.

[11] Patent Number: 6,001,549

[45] Date of Patent: Dec. 14, 1999

[54] ELECTRICALLY CONDUCTIVE LAYER COMPRISING MICROGEL PARTICLES

[75] Inventors: Mridula Nair, Penfield; Lloyd A. Lobo, Webster; Tamara K. Osburn, Rochester, all of N.Y.

[73] Assignee: Eastman Kodak Company, Rochester, N.Y.

[21] Appl. No.: 09/085,738

[22] Filed: May 27, 1998

[51] Int. Cl.[6] ..... G03C 1/89

[52] U.S. Cl. ..... 430/528; 430/527; 430/529; 430/530

[58] Field of Search ..... 430/527, 528, 430/529, 530

[56] References Cited

U.S. PATENT DOCUMENTS

| | | | |
|---|---|---|---|
| 4,275,103 | 6/1981 | Tsubusaki et al. | 428/148 |
| 4,394,441 | 7/1983 | Kawaguchi et al. | 430/527 |
| 4,416,963 | 11/1983 | Takimoto et al. | 430/69 |
| 4,418,141 | 11/1983 | Kawaguchi et al. | 430/530 |
| 4,431,764 | 2/1984 | Yoshizumi | 524/409 |
| 4,495,276 | 1/1985 | Takimoto et al. | 430/527 |
| 4,571,361 | 2/1986 | Kawaguchi et al. | 428/328 |
| 4,845,369 | 7/1989 | Arakawa et al. | 250/484.1 |
| 4,999,276 | 3/1991 | Kuwabara et al. | 430/527 |
| 5,340,676 | 8/1994 | Anderson et al. | 430/527 |
| 5,368,995 | 11/1994 | Christian et al. | 430/530 |
| 5,466,567 | 11/1995 | Anderson et al. | 430/527 |
| 5,698,384 | 12/1997 | Anderson et al. | 430/530 |
| 5,849,472 | 12/1998 | Wang et al. | 430/530 |

*Primary Examiner*—Richard L. Schilling
*Attorney, Agent, or Firm*—Carl F. Ruoff

[57] ABSTRACT

The present invention is an imaging element which includes a support, an image forming layer superposed on the support; and an antistatic layer superposed on the support. The antistatic layer includes electrically conductive particles at a 10–60 volume percent and microgel particles. The microgel particles are composed of 25 to about 80 weight percent of an oleophilic monomer, 5 to about 45 weight percent of a hydrophilic monomer, and 0 to 20 weight percent of a crosslinking monomer having at least two addition polymerizable groups. In an alternative embodiment the antistatic layer also includes a binder.

10 Claims, No Drawings

ELECTRICALLY CONDUCTIVE LAYER COMPRISING MICROGEL PARTICLES

FIELD OF THE INVENTION

This invention relates in general to imaging elements, such as photographic, electrostatographic and thermal imaging elements, and in particular to imaging elements comprising a support, an image-forming layer and an electrically-conductive layer. More specifically, this invention relates to such imaging elements having an electrically-conductive layer containing electrically-conductive particles and microgel particles.

BACKGROUND OF THE INVENTION

In the photographic industry, the need to provide photographic film and paper with antistatic protection has long been recognized. In instances where the main need for antistatic protection is prior to processing, materials that provide temporary antistatic protection are acceptable. By temporary, we mean that the antistatic material may react or dissolve in the photographic processing solutions and lose some or all of its ability to provide antistatic protection. Permanent antistatic materials, on the other hand, are those that do not lose their antistatic property even after the photographic product has been processed. The latter kind of antistatic material is more desired in products which are subjected to high speed transport after processing, such as microfilm materials, or which have a magnetic recording layer incorporated in the coating, in which case static discharge can contribute to magnetic signal noise. From a product performance standpoint, a permanent antistat material would minimize the amount of dust adhering to a product. Such permanent antistatic properties can be obtained by ionic conductors like ionic conductive polymers as well as by electronic conductors such as fine particles of crystalline metal oxides. The antistatic properties of ionic conductors are typically sensitive to humidity conditions, whereas electronic conductors are not. Therefore, the fine particles of crystalline metal oxides are the preferred antistatic materials.

There are several types of crystalline metal oxide particulates which are used to prepare optically transparent antistatic coatings. Examples of these are disclosed in U.S. Pat. Nos. 4,275,103, 4,394,441, 4,416,963, 4,418,141, 4,431,764, 4,495,276, 4,571,361, 4,999,276 and 5,368,995. Preferred materials are antimony doped tin oxide, aluminium doped zinc oxide, and metal antimonates. For coatings used in imaging applications, the particle size of these powders should be small, in order to minimize light scattering and haze. The high propensity for scattering light, by these particles is due to their relatively high refractive index. In order for thin coatings of these materials to possess the required antistatic property, the volume fraction of these materials in the coatings needs to be relatively high (>50% by volume). The need for high volume fraction of the metal oxide particles is that they should form a gelled network of particles which typically occurs beyond a characteristic percolation threshold in the volume fraction. Above the threshold value of the volume fraction, the surface conductivity is relatively high. Below the threshold value, the surface conductivity drops several fold and reaches a low value. The surface conductivity of coatings of these materials typically has a value desired for photographic applications provided the volume fraction of the antistatic material is 50 volume percent or higher. In order to form a coating the antistatic materials are coated with a polymeric binder.

Binder materials in coatings are either water soluble or water dispersable polymers, such as gelatin or film forming latexes, or solvent soluble polymers such as polyurethanes. Coatings of these polymers have mechanical properties of glassy materials, once the coatings have been dried. However, the integrity and mechanical strength of coatings of composite materials, in which the binder is less than 50 percent by volume, is low, especially when the particulate filler material such as crystalline metal oxide particles is very different in mechanical properties from the binder material which is glassy. Thus, the requirements of the coating, to have a high electrical conductivity and to have reasonable mechanical strength, is difficult to acheive simultaneously.

U.S. Pat. No. 5,340,676 discloses the use nonswellable, insoluble polymer latex particles along with gelatin, in order to increase the conductivity of the coating at relatively lower volume fractions of the conductive metal oxide particles. However, while the conductivity is improved by addition of non-swellable polymer latex particles, the adhesion of other layers of the imaging element to the conductive layer is compromised with increasing latex content of the conductive layer. U.S. Ser. No. 08/816,650, now U.S. Pat. No. 5,849,472, discloses the use of carboxylic acid containing polymer latex particles for similar reasons, with the added advantage of increasing the permeability of the coated layer to processing solutions required to produce images. U.S. Pat. No. 5,466,567 describes the addition of pre-crosslinked gelatin particles to the soluble gelatin binder of the conductive layer to improve conductivity. However such particles are difficult to prepare and disperse in water and their size and size distribution are not easily controlled.

Antistatic coatings, with adequate surface conductivity, but with a low volume fraction of metal oxide can also be obtained by using fibrous powders of these materials, as disclosed in U.S. Pat. No. 4,845,369. The aspect ratio of these fibers is typically greater than 50. However, due to their larger size in one dimension and high refractive index, they have greater potential to scatter light than the small particles. Secondly, the fibrous materials are more difficult to manufacture and, thus, cost more.

Thus, it is desirable to produce coatings of antistatic materials, having small conductive particles whose volume fraction in the coating is less than 50 percent, which have good electrical conductivity (resistivity $<10^{10}$ ohm/square) and which have good adhesion to other layers of the imaging element coated over them such as curl control layers or light sensitive layers.

SUMMARY OF THE INVENTION

The present invention is an imaging element which includes a support, an image forming layer superposed on the support; and an antistatic layer superposed on the support. The antistatic layer includes electrically conductive particles at a 10–60 volume percent and microgel particles. The microgel particles are composed of 25 to about 80 weight percent of an oleophilic monomer, 5 to about 45 weight percent of a hydrophilic monomer, and 0 to 20 weight percent of a crosslinking monomer having at least two addition polymerizable groups. In an alternative embodiment the antistatic layer also includes a binder.

DETAILED DESCRIPTION OF THE INVENTION

This invention relates to imaging elements comprising a support, one or more image forming layers and one or more electrically conductive layers. Such elements include photographic, electrostatographic, photothermographic, electrothermographic and thermal dye transfer elements.

Photographic elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer coated paper, and the like. The image forming layer or layers typically comprise a radiation-sensitive silver halide emulsion layer. The photographic element can be simple black and white or monochrome elements or they can be multilayer and/or multicolor elements.

The electrically conductive layer in this invention comprises, at least, the following two components: electrically conductive particles and polymer microgel particles. The layer has good conductivity at relatively low volume fraction of the conductive particles by including the polymer microgel particles. Optionally, the electrically conductive layer includes a binder, such as a hydrophilic colloid.

Suitable electrically conductive particles include those previously proposed for use in antistatic layers for various imaging applications, such as crystalline metal oxides, metal antimonates, and ceramic particles which have been used to prepare optically transparent, humidity insensitive, antistatic layers. Many different metal oxides, such as ZnO, $TiO_2$, $ZrO_2$, $SnO_2$, $Al_2O_3$, $In_2O_3$, $SiO_2$, MgO, BaO, $MoO_3$ and $V_2O_5$, are proposed for use as antistatic agents in photographic elements or as conductive agents in electrostatographic elements in such patents as U.S. Pat. Nos. 4,275,103, 4,394,441, 4,416,963, 4,418,141, 4,431,764, 4,495,276, 4,571,361, 4,999,276 and 5,122,445. Electronically-conductive metal antimonates are disclosed in U.S. Pat. No. 5,457,013. Antistatic layers comprising electro-conductive ceramic particles, such as particles of TiN, $NbB_2$, TiC, $LaB_6$ or MoB, dispersed in a binder such as a water-soluble polymer or solvent-soluble resin are described in Japanese Kokai No. 4/55492, published Feb. 24, 1992. Preferred conductive particles include metal oxides such as antimony doped tin oxide, aluminum doped zinc oxide, and niobium doped titanium oxide, and metal antimonates such as the rutile or rutile-related crystallographic structures represented by $M^{+2}Sb^{+5}{}_2O_6$ or $M^{+3}Sb^{+5}O_4$ where $M^{+2}=Zn^{+2}$, $Ni^{+2}$, $Mg^{+2}$, $Fe^{+2}$, $Cu^{+2}$, $Mn^{+2}$, $Co^{+2}$ and $M^{+3}=In^{+3}$, $Al^{+3}$, $Sc^{+3}$, $Cr^{+3}$, $Fe^{+3}$, $Ga^{+3}$.

Surface resistivities are preferably in the range from $10^6$–$10^9$ ohms per square for highly loaded antistatic layers containing the conductive particles. In order to obtain such high electrical conductivity, 0.1–10 $g/m^2$ of metal oxide is typically included in the antistatic layer. High coating levels, however, may result in decreased optical transparency for thick antistatic coatings. In order to minimize light scattering (haze) by the antistatic layer due to the high values of refractive index (>2.0) of the preferred metal oxides, the metal oxides are preferably dispersed in the form of ultrafine particles. For use in imaging elements, the average particle size of the electrically-conductive particles is preferably less than about one micrometer, more preferably less than about 0.5 micrometers and most preferably less than 0.1 micrometers. For use in imaging elements where a high degree of transparency is important, it is preferred to use colloidal particles which have an average particle size in the range of 0.01 to 0.05 micrometers.

Several colloidal conductive metal antimonates are commercially available from Nissan Chemical Industries Ltd. in the form of dispersions in water or in organic solvents. (See published Japanese Patent Application No. 6-219743.) Alternatively, U.S. Pat. Nos. 4,169,104 and 4,110,247 teach a method for preparing certain metal antimonates by treating an aqueous solution of potassium antimonate (i.e., $KSb(OH)_6$) with an aqueous solution of an appropriate soluble metal salt (e.g., chloride, nitrate, sulfate, etc.) to form a gelatinous precipitate of the corresponding insoluble hydrate. The isolated hydrated gels are then washed with water to remove the excess potassium ions and salt anions. The washed gels are peptized by treatment with an aqueous solution of organic base (e.g., triethanolamine, tripropanolamine, diethanolamine, monoethanolamine, quaternary ammonium hydroxides, etc.) at temperatures of 25 to 150° C. as taught in U.S. Pat. No. 4,589,997 for the preparation of colloidal antimony pentoxide sols.

In order to be suitable for use in antistatic coatings for critical photographic applications, the conductive particles must have a small average particle size. Small particle size minimizes light scattering which would otherwise result in reduced optical transparency of the coating. The relationship between the size of a particle, the ratio of its refractive index to that of the medium in which it is incorporated, the wavelength of the incident light, and the light scattering efficiency of the particle is described by Mie scattering theory (G. Mie, Ann, Physik., 25, 377 (1908). A discussion of this topic as it is relevant to photographic applications has been presented by T. H. James ("The Theory of the Photographic Process", 4th ed., Rochester: EKC, 1977). In the case of electroconductive particles coated in a thin layer using a typical photographic gelatin binder system, it is necessary to use powders with an average particle size less than about 0.2 $\mu$m in order to limit the scattering of light at a wavelength of 550 nm to less than 20 percent. For shorter wavelength light, such as the ultraviolet light used to expose some daylight-insensitive graphic arts films, electroconductive particles with an average size much less than about 0.1 $\mu$m are preferred.

In addition to the optical requirements, a very small average particle size is needed to ensure that even in thin coatings there is a multiplicity of interconnected chains or networks of conductive particles which afford multiple electrically-conductive pathways through the layer and result in electrical continuity. The very small average particle size of conductive colloidal metal antimonate particles (typically 0.01–0.05 $\mu$m) results in multiple conductive pathways in thin antistatic layers of preferred embodiments of the present invention. In the case of other commercially available conductive metal oxide pigments, the average particle size (typically 0.5–0.9 $\mu$m) can be reduced by various mechanical milling processes well known in the art of pigment dispersion and paint making. However, many of these metal oxide pigments may not be sufficiently chemically homogeneous to permit size reduction by attrition to the colloidal size required to ensure both optical transparency and multiple conductive pathways in thin coatings and still retain sufficient inter-particle conductivity to be useful in an antistatic layer.

In accordance with the current invention, it is desired to achieve a coating with a high surface conductivity, by utilizing a relatively low volume fraction of conductive particles. A high conductivity of a coating, containing the conductive particles is achieved when network structure of the particles is achieved, upon the coating being dried. Although a small particle size of the conductive particles are desired in order to achieve this, there is a limit to the minimum size of the particles that can be practically achieved. The minimum volume fraction of conductive particles that is required to form this network, can be reduced when polymer microgel particles are present. These particles act as space fillers during the process of drying. Thus, they should have a high modulus of elasticity as well as a Tg (glass transition temperature) that is higher (≧20° C.) than the temperature used during the drying processes. The polymer microgels used in this invention are able to fulfil these requirements.

Microgel particles are intramolecularly crosslinked polymer particles that have a permanent shape and solubility at the same time. Contrary to the nonswellable crosslinked latex particles of U.S. Pat. No. 5,340,676, microgel particles are highly swollen and form colloidal solutions. They have porous spongelike structures. The swollen porous nature of the microgel particles, along with its oleophilic and hydrophilic monomer components results in better bonding at interfaces such as, at the electrically conductive particle surfaces and to gelatin compared to the nonswellable latex particles of the '676 patent. This leads to enhanced cohesive strength of the electrically conductive layer.

The electrically conductive layers of the invention provide conductive layers that require a lower concentration of electrically conductive particles compared to layers that only comprise conductive particles and gelatin at equivalent laydown. This provides a layer that has better optical properties and better layer integrity. Another advantage achieved by this invention, is that at similar concentration of electrically conductive particles in the coating, the invention can utilize a lower laydown of conductive particles compared to layers that only comprise conductive particles and gelatin, while maintaining the desired level of surface conductivity. This advantage directly results in a lower cost of materials required to fabricate the coating of desired properties, since the cost of the conductive particles is higher than that of the polymer microgel particles used in the invention. The electrically conductive layer may be applied as an intermediate layer or as an outer layer on either side or both sides of the support. Another advantage of the present invention is that better wet adhesion to a gelatin overcoat layer is obtained using the microgel particles than using the antistatic layer of U.S. Pat. No. 5,340,676.

The polymer microgel particles that are used in this invention are copolymers of at least three different monomers; about 25 to about 80% by weight of a oleophilic monomer, about 5 to about 45% by weight of one or more hydrophilic monomers and 0 to 20% by weight of of a crosslinking monomer having at least two addition polymerizable groups. The hydrophilic monomers may consist of nonionic or ionic entities. Preferably, the copolymer is the reaction product of about 35% to about 65% by weight of the oleophilic monomer, about 1 to 60% by weight of the hydrophilic monomer and 5 to 15% of the crosslinking monomer.

The monomers used in forming the microgel particles used in this invention include addition polymerizable monomers containing ethylenic unsaturation or more specifically vinylic, acrylic and/or allylic groups. Examples of suitable nonionic oleophilic monomers include, n-pentyl acrylate, n-butyl acrylate, benzyl acrylate, t-butyl methacrylate, 1,1-dihydroperfluorobutyl acrylate, benzyl methacrylate, m and p-chloromethylstyrene, butadiene, 2-chloroethyl methacrylate, ethyl methacrylate, isobutyl acrylate, 2-ethylhexyl acrylate, 2-ethylhexyl methacrylate, chloroprene, n-butyl methacrylate, isobutyl methacrylate, isopropyl methacrylate, lauryl acrylate, lauryl methacrylate, methyl acrylate, methyl methacrylate, 2-ethoxyethyl acrylate, 2-ethoxyethyl methacrylate, 2-cyanoethyl acrylate, phenyl acrylate, isopropyl acrylate, n-propyl methacrylate, n-hexyl acrylate, styrene, secbutyl acrylate, p-t-butylstyrene, N-t-butylacrylamide, vinyl acetate, vinyl bromide, vinylidene bromide, vinyl chloride, m and p-vinyltoluene, α-methylstyrene, methyl p-styrenesulfonate, vinylbenzyl acetate and vinyl benzoate.

Examples of suitable nonionic hydrophilic monomers that are useful for making the copolymer microgels used in this invention include, for example, acrylamide, allyl alcohol, n-(isobutoxymethyl)acrylamide, N-(isobutoxymethyl) methacrylamide, m and p-vinylbenzyl alcohol, cyanomethyl methacrylate, 2-poly(ethyleneoxy)ethyl acrylate, methacryloyloxypolyglycerol, glyceryl methacrylate, 2-hydroxyethyl acrylate, 2-hydroxypropyl acrylate, n-isopropylacrylamide, 2methyl-1-vinylimidazole, 1-vinylimidazole, methacrylamide, 2-hydroxyethyl methacrylate, methacryloylurea, acrylonitrile, methacrylonitrile, N-acryloylpiperidine, 2-hydroxypropyl methacrylate, N-vinyl-2-pyrrolidone, p-aminostyrene, N,N-dimethylmethacrylamide, N-methylacrylamide, 2-methyl-5-vinylpyridine, 2-vinylpyridine, 4vinylpyridine, N-isopropylmethacrylamide, N,N-dimethylacrylamide, 2-(diethylamino)ethyl acrylate, 2-(dimethylamino)ethyl acrylate, 2-(dimethylamino)ethyl methacrylate, and 2-(diethylamino)ethyl methacrylate Suitable ionic hydrophilic monomers that can be used in the copolymer microgels include both anionic and cationic monomers that can ionize in water at pH 3 or higher. Examples of such anionic monomers are aconitic acid, acrylic acid, methacrylic acid, fumaric acid, itaconic acid, maleic acid, 2-methacryloyloxyethylsulfuric acid, sodium salt, pyridinium 2-methacryloyloxyethylsulfate, 3-acrylamidopropane-1-sulfonic acid, potassium salt, p-styrenesulfonic acid, sodium salt, 3methacryloyloxypropane-1-sulfonic acid, sodium salt, 2acrylamido-2-methylpropanesulfonic acid, methacrylic acid, sodium salt, lithium methacrylate, 2-methacryloyloxyethyl 1 sulfonic acid ammonium p-styrenesulfonate, and sodium o and p-styrenesulfonate. Examples of suitable cationic monomers include, for example, N-(3-acrylamidopropyl)ammonium methacrylate, N-(2-methacryloyloxyethyl)-N,N,N-trimethylammonium iodide, N-(2-methacryloyloxyethyl)-N,N,N-trimethylammonium p-toluenesulfonate, 1,2-dimethyl-5-vinylpyridinium methosulfate, N-(2-methacryloyloxyethyl)-N,N,N-trimethylammonium bromide, N-(2-methacryloyloxyethyl)-N, N,N-trimethylammonium fluoride, N-vinylbenzyl-N,N,Ntrimethylammonium chloride, 3-methyl-1-vinylimidazolium methosulfate, N-(3-methacrylamidopropyl)-N-benzyl-N,N-dimethylammonium chloride, and N-(3-methacrylamidopropyl-N,N,N-trimethylammonium chloride.

Such aforementioned hydrophilic monomers are well known in the art and are generally considered to be monomers that can be mixed in an excess of water, e.g., a minimum of 2 grams of monomer in 100 grams of water, at 25° C. to form homogeneous solutions or dispersions in the absence of a stabilizing agent. Such a solution or dispersion has a substantially uniform composition throughout. In contrast, the oleophilic monomers previously described herein fail to meet these criteria.

Suitable crosslinking monomers useful for making the copolymer microgels used in this invention include, for example, N,N'-methylenebisacrylamide, ethylene dimethacrylate, 2,2-dimethyl-1,3-propylene diacrylate, divinylbenzene, N,N'-bis(methacryloyl)urea, 4,4'-isoproylidenediphenylene diacrylate, 1,3-butylene diacrylate, 1,4-cyclohexylenedimethylene dimethacrylate, ethylene diacrylate, ethylidene diacrylate, 1,6-diacrylamidohexane, 1,6-hexamethylene diacrylate, 1,6-hexamethylene dimethacrylate, tetramethylene dimethacrylate, ethylenebis(oxyethylene)diacrylate, ethylenebis(oxyethylene)dimethacrylate, ethylidyne trimethacrylate and 2-crotonoyloxyethyl methacrylate.

The polymer microgel particles used in this invention are conveniently prepared by aqueous emulsion polymerization processes, as described in U.S. Pat. No. 4,965,131, incorporated by reference herein. In a typical emulsion polymerization process, the water is degassed with an inert gas such as argon or nitrogen, to remove oxygen, and a surfactant and a mixture of the monomers are added to the water. The initiator is added and the mixture is heated at about 80° C. to 90° C. for about 1 to 3 hours. The polymerization is complete when the monomer concentration, which can be monitored, diminishes to nearly zero.

The resulting copolymers typically have average diameters (swollen, in water) in the range of about 0.01 to about 1.0 micrometer, often about 0.01 to about 0.15 micrometer.

Other methods of preparation of microgel particles may also be used by those skilled in the art. Specific examples of microgel particles that are especially useful in the imaging elements of this invention include the microgel particles A–E listed in Table 1 below. Example F is a comparative example and contains more than the required amount of oleophilic monomer and has a Tg below 20° C.

TABLE 1

| Microgel | Description |
|---|---|
| A | Methyl methacrylate/hydroxyethyl methacrylate/methacrylic acid/ethylene glycol dimethacrylate 57/30/10/3 |
| B | Methyl methacrylate/poly(ethylene oxide) monomethacrylate/methacrylic acid/ethylene glycol dimethacrylate 57/30/10/3 |
| C | Styrene/hydroxyethyl methacrylate/methacrylic acid/ethylene glycol dimethacrylate 45/30/15/10 |
| D | Styrene/n-butylmethacrylate/hydroxyethyl methacrylate/methacrylic acid/ethylene glycol dimethacrylate 24/38/30/5/3 |
| E | Methyl methacrylate/hydroxyethyl methacrylate/methacrylic acid 57/33/10 |
| F | n-Butyl acrylate/poly(ethylene oxide) monomethacrylate/methacrylic acid 85/10/5 |

Binders useful in the highly loaded thin layers of the invention, such as antistatic layers containing conductive particles such as metal antimonate particles, include: water-soluble polymers such as gelatin, gelatin derivatives, maleic acid anhydride copolymers; cellulose compounds such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamides, their derivatives and partially hydrolyzed products, vinyl polymers and copolymers such as polyvinyl acetate and polyacrylate acid esters; derivatives of the above polymers; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, olefins, and aqueous dispersions of polyurethanes or polyesterionomers. Solvents useful for preparing coatings of conductive particles include: water, alcohols such as methanol, ethanol, propanol, isopropanol; ketones such as acetone, methylethyl ketone, and methylisobutyl ketone; esters such as methyl acetate, and ethyl acetate; glycol ethers such as 2-methoxyethanol, 2-ethoxyethanol, 1-methoxy-2-propanol; and mixtures thereof. In preferred embodiments of the invention, an aqueous soluble or dispersible binder, preferably gelatin, is used and the highly loaded layer is coated from an aqueous based coating composition.

In accordance with the current invention, it is desired to achieve a coating with a high surface conductivity, by utilizing a relatively low volume fraction of electrically conductive particles. This is achieved by including the microgel particles and optionally a binder. If the volume ratio of microgel particles to binder is too low, the required conductivity cannot be achieved at the low volume fraction of the electrically conductive particles. If the volume ratio is too high the cohesive strength of the coated film may be low. The volume fraction of the electrically conductive particles in the electrically conductive layer is in the range from 10 to 60 percent, with the preferred range of 20 to 40%.

However, in addition to the electrically-conductive fine particles and microgel particles, the electrically-conductive layer can optionally contain wetting aids, lubricants, matte particles, biocides, dispersing aids, hardeners and antihalation dyes.

Matte particles well known in the art that may be used in the electrically-conductive layers of the invention have been described in Research Disclosure No. 308119, published December 1989, pages 1008 to 1009, for example.

Typical lubricants that may be effectively employed in the electrically-conductive layers of the invention include (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc disclosed in U.S. Pat. Nos. 2,454,043, 2,732,305, 2,976,148, 3,206,311, 3,933,516, 2,588,765, 3,121,060, 3,502,473, 3,042,222, and 4,427,964, in British Patent Nos. 1,263,722, 1,198,387, 1,430,997, 1,466,304, 1,320,757, 1,320,565, and 1,320,756, and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly (tetrafluoroethlyene), poly(trifluorochloroethylene), poly (vinylidene fluoride, poly(trifluorochloroethylene-co-vinyl chloride), poly(meth)acrylates or poly(meth)acrylamides containing perfluoroalkyl side groups, and the like. Lubricants useful in the present invention are described in further detail in Research Disclosure No.308119, published December 1989, page 1006.

The invention is further illustrated by the following examples:

EXAMPLES 1–10

The antistat material used in this example comprises of conductive zinc antimonate particles (Nissan Chemcal Industries Ltd.), with a particle size between 10 to 50 nanometers. A series of coatings of this material was made using gelatin as the binder. The weight fraction of the electrically conductive particles in the layer was maintained at 65 percent which corresponds to approximately 25% by volume occupied by the electrically conductive particles. The conductive particles and gelatin binder were coated on a 4 mil thick polyethylene terephthalate film support subbed with a terpolymer of acrylonitrile, vinylidene chloride and acrylic acid and a gelatin primer layer. The coating was made at varying laydowns of the conductive particles. The invention was prepared in a similar manner, except that the layer contained a mixture of gelatin and microgel particles A in a weight ratio of 2:1. All coatings also contained a gelatin hardener at a level corresponding to 3% by weight of the amount of gelatin present in the coating and the coatings were dried at 100–120° C. The surface resistivity of the coatings were then measured using a two-point probe at 20% relative humidity and are listed in Table 2.

TABLE 2

| Examples | Coverage of conductive particles (mg/ft$^2$) | Surface Resistivity log ohm/square gelatin | Surface Resistivity log ohm/square gelatin + A |
|---|---|---|---|
| 1 | 20 | | 9.35 |
| 2 | 25 | | 8.73 |
| 3 | 30 | 9.9 | 8.2 |
| 4 | 35 | 9.65 | 8.25 |
| 5 | 40 | 9.75 | 7.78 |
| 6 | 45 | 9.59 | 7.6 |
| 7 | 50 | 9.45 | 7.65 |
| 8 | 55 | 9.25 | 7.5 |
| 9 | 60 | 8.6 | |
| 10 | 65 | 8.23 | |

The data in Table 2 show that by practicing the invention, we are able to use a much smaller laydown of the zinc antimonate conductive material to achieve a desired value of surface resistivity (inverse of surface conductivity) than by using gelatin alone.

EXAMPLES 11–15

In the manner described in Examples 1–10, electrically conductive coatings containing 65 percent weight fraction of electrically conductive particles were prepared in which the ratio of the microgel A to gelatin was varied. The laydown of the electrically conductive particles in these coatings was 35 mg/ft$^2$. The gelatin containing coating were hardened as described in Example 1–10. Surface resistivities were measured as in Examples 1–10. These coatings were subsequently overcoated with a gelatin layer also containing bis(vinyl methyl)sulfone hardener in order to simulate overcoating with a photographic or curl control layer. The gelatin layer was dried to give a dry coating weight of 100 mg/ft$^2$. The internal resistivities of the overcoated samples were measured using a salt bridge. This measure is equivalent to the surface resistivity of an electrcially conductive surface that has not been overcoated. The wet adhesion of the overcoat to the electrically conductive layer was measured by rubbing across the coating with a cotton swab soaked in hot water. If no removal of the conductive layer was observed after 80 wipes, the adhesion of the overcoat to the conductive layer was considered excellent. The surface resistivities and wet adhesion of these coatings are listed in Table 3.

TABLE 3

| Examples | Weight ratio of A to gelatin | Surface Resistivity log ohm/square Before overcoating | Internal Resistivity log ohm/square After overcoating | Wet adhesion after overcoating |
|---|---|---|---|---|
| 11 | 1:0 | 8.1 | 8.2 | Excellent |
| 12 | 2:1 | 8.0 | 8.3 | Excellent |
| 13 | 1:1 | 8.2 | 8.6 | Excellent |
| 14 | 1:2 | 8.5 | 9.2 | Excellent |
| 15 | 0:1 | 9.9 | 12.3 | Excellent |

The data in Table 3 show that even with no gelatin present in the conductive layer, the gelatin overcoat adheres quite effectively to the microgel layer underneath. Hence increasing the microgel particle to gelatin ratio in the conductive layer does not cause a reduction in adhesion to the layer above it. Furthermore, as Table 3 shows, increasing the microgel particle to gelatin ratio provides the added advantage of increased conductivity (surface resistivity values) and reduced mixing with the overcoat layer as seen from the internal resitivity values.

EXAMPLES 16–21

In the manner described in Examples 1–10, electrically conductive coatings were prepared in which the ratio of the microgel particle A to gelatin was kept constant at 1:2 but the weight fraction of the electrically conductive particles was varied for different dry coverages of the conductive particles. The coatings contained a hardener as described in Examples 1–10. The surface resistivities and wet adhesion measured as described in Examples 11–15, are listed in Table 4

TABLE 4

| Examples | Weight fraction of conductive particles (%) | Coverage of conductive particles (mg/ft$^2$) | Surface Resistivity log ohm/square | Wet Adhesion |
|---|---|---|---|---|
| 16 | 75 | 25 | 8.4 | Fair |
| 17 | 75 | 35 | 7.7 | Fair |
| 18 | 75 | 45 | 7.3 | Fair |
| 19 | 65 | 25 | 9.2 | Excellent |
| 20 | 65 | 35 | 8.3 | Excellent |
| 21 | 65 | 45 | 8.1 | Excellent |

The data in Table 4 show that it is more advantageous to reduce the weight fraction of the conductive particles in order to get better wet adhesion of the electrically conductive layer. Although with gelatin alone (Examples 1–10) the conductivity of the layer is lowered, the addition of microgel particles increases the conductivity of the layer. Even at 25 mg/ft$^2$ dry coverage of the conductive particles (Example 19), the conductivity is as good as gelatin alone at 35 mg/ft$^2$ (see Table 2, Example 4)

EXAMPLES 22–26

The zinc antimonate conductive particles were coated with gelatin and various microgel particles on the same support as described in Examples 1–10. The weight ratio of gelatin to microgel particles was maintained at 2:1 The coatings were made at a constant coverage of 30 mg/ft$^2$ of zinc antimonate conductive particles. The volume fraction of the conductive particles in the coated layer was varied by changing the amount of gelatin and microgel particles that were coated along with the conductive particles. The coatings also contained a gelatin hardener (bis-vinylsulfone methyl ether) at a level corresponding to 3% of the amount of gelatin present in the coating. The surface resistivities of the coatings were measured as in Examples 1–10 and are listed in Table 5, at the various volume fractions of the conductive particles in the coating.

TABLE 5

| Examples | Volume fraction of conductive particles | 0.51 | 0.36 | 0.22 |
|---|---|---|---|---|
| | | Surface Resistivity log ohm/square (after processing) | | |
| 22 | gelatin | 8.125 (8.4) | 8.975 (10.4) | 12.6 (14) |
| 23 | gelatin + A | 8 (8.6) | 8.1 (8.4) | 9.6 (9.9) |
| 24 | gelatin + B | 8.1 (8.5) | 8.5 (8.6) | 10.3 (10.3) |
| 25 | gelatin + C | 7.9 (8.7) | 8.25 (8.9) | 9.9 (11.6) |
| 26 | gelatin + F | 8.7 (9.0) | 8.9 (9.0) | 12.1 (13.1) |

As seen in Table 5, relatively low resistivities can be obtained at volume fractions of conductive particles, as low as 0.22, when microgel particles are used along with gelatin. On the other hand, if gelatin is used alone (Example 22) or if the polymer particles used are not microgel particles (Example 26), the resisitivities of the coatings are high at volume fractions lower than 0.36 of the electrically conductive particles. Further, as indicated by the data in Table 5, use of A, B or C in combination with gelatin gave good electroconductive properties even after processing. The loss in conductivity after processing is much more substantial when no microgel particles were present or when the particles present were outside the defined microgel composition.

EXAMPLES 27–33

In the manner described in Examples 1–10, electrically conductive coatings were prepared in which the microgel particles D and E were used and compared to gelatin and microgel particle A. The weight fraction of the electrically conductive particles in the layer was 0.65 and the laydown was 35 mg/ft$^2$. The gelatin containing coatings were hardened as described in Examples 1–10. The microgel particles were used alone and in conjunction with gelatin at a weight ratio of 2:1 (gelatin:microgel particles). As the data show, the microgel particles by themselves and along with gelatin provide conductivities that are 2–3 orders of magnitude better than gelatin alone. All coatings showed excellent adhesion to a gelatin overcoat applied to the coatings as described in Example 11–15.

TABLE 6

| Examples | Binder composition | Surface Resistivity log ohm/square |
|---|---|---|
| 27 | Gelatin | 10.6 |
| 28 | A | 8.4 |
| 29 | A + Gelatin | 8.4 |
| 30 | D | 7.9 |
| 31 | D + gelatin | 8.9 |

TABLE 6-continued

| Examples | Binder composition | Surface Resistivity log ohm/square |
|---|---|---|
| 32 | E | 8.6 |
| 33 | E + gelatin | 8.2 |

The invention has been described in detail with particular reference to certain preferred embodiments thereof, but it will be understood that variations and modifications can be effected within the spirit and scope of the invention.

What is claimed is:

1. An imaging element comprising:

a support;

an image forming layer superposed on said support; and an antistatic layer superposed on said support comprising electrically conductive particles at a 10–60 volume percent, and copolymer microgel particles comprising 25 to about 80 weight percent of an addition polymerizable oleophilic monomer, 5 to about 45 weight percent of addition polymerizable hydrophilic monomers, and 0 to 20 weight percent of a crosslinking monomer having at least two addition polymerizable groups, wherein the hydrophilic monomers comprise nonionic and ionic monomers, such that the weight ratio of the hydrophilic nonionic monomers to the ionic monomers is equal to or greater than 2.

2. The imaging element of claim 1, wherein the electrically conductive particles comprise crystalline metal oxides, metal antimonates, or ceramic particles.

3. The imaging element of claim 1, wherein the electrically conductive particles have an average particle size of less than 1 micrometer.

4. The imaging element of claim 1 wherein the oleophilic monomer comprises n-pentyl acrylate, n-butyl acrylate, benzyl acrylate, t-butyl methacrylate, 1,1-dihydroperfluorobutyl acrylate, benzyl methacrylate, mand p-chloromethylstyrene, butadiene, 2-chloroethyl methacrylate, ethyl methacrylate, isobutyl acrylate, 2-ethylhexyl acrylate, 2-ethylhexyl methacrylate, chloroprene, n-butyl methacrylate, isobutyl methacrylate, isopropyl methacrylate, lauryl acrylate, lauryl methacrylate, methyl acrylate, methyl methacrylate, 2-ethoxyethyl acrylate, 2-ethoxyethyl methacrylate, 2-cyanoethyl acrylate, phenyl acrylate, isopropyl acrylate, n-propyl methacrylate, n-hexyl acrylate, styrene, secbutyl acrylate, p-t-butylstyrene, N-t-butylacrylamide, vinyl acetate, vinyl bromide, vinylidene bromide, vinyl chloride, m and p-vinyltoluene, α-methylstyrene, methyl p-styrenesulfonate, vinylbenzyl acetate or vinyl benzoate.

5. The imaging element of claim 1 wherein the hydrophilic monomers comprise acrylamide, allyl alcohol, n-(isobutoxymethyl)acrylamide, N-(isobutoxymethyl) methacrylamide, mand p-vinylbenzyl alcohol, cyanomethyl methacrylate, 2-poly(ethyleneoxy)ethyl acrylate, methacryloyloxypolyglycerol, glyceryl methacrylate, 2-hydroxyethyl acrylate, 2-hydroxypropyl acrylate, n-isopropylacrylamide, 2-methyl-1-vinylimidazole, 1-vinylimidazole, methacrylamide, 2-hydroxyethyl methacrylate, methacryloylurea, acrylonitrile, methacrylonitrile, N-acryloylpiperidine, 2-hydroxypropyl methacrylate, N-vinyl-2-pyrrolidone, p-aminostyrene, N,N-dimethylmethacrylamide, N-methylacrylamide, 2-methyl-5-vinylpyridine, 2-vinylpyridine, 4vinylpyridine, N-isopropylmethacrylamide, N,N-dimethylacrylamide, 2-(diethylamino)ethyl acrylate, 2-(dimethylamino)ethyl acrylate, 2-(dimethylamino)ethyl methacrylate, 2-(diethylamino)ethyl methacrylate, aconitic acid, acrylic acid, methacrylic acid, fumaric acid, itaconic acid, maleic acid, 2-methacryloyloxyethylsulfuric acid, sodium salt, pyridinium 2-methacryloyloxyethylsulfate, 3-acrylamidopropane-1-sulfonic acid, potassium salt, p-styrenesulfonic acid, sodium salt, 3methacryloyloxypropane-1-sulfonic acid, sodium salt, 2acrylamido-2-methylpropanesulfonic acid, methacrylic acid, sodium salt, lithium methacrylate, 2-methacryloyloxyethyl 1 sulfonic acid ammonium p-styrenesulfonate, sodium styrenesulfonate, N-(3-acrylamidopropyl)ammonium methacrylate, N-(2-methacryloyloxyethyl)-N,N,N-trimethylammonium iodide, N-(2-methacryloyloxyethyl)-N,N,N-trimethylammonium p-toluenesulfonate, 1,2-dimethyl-5-vinylpyridinium methosulfate, N-(2-methacryloyloxyethyl)-N,N,N-trimethylammonium bromide, N-(2-methacryloyloxyethyl)-N, N,N-trimethylammonium fluoride, N-vinylbenzyl-N,N, Ntrimethylammonium chloride, 3-methyl-1-vinylimidazolium methosulfate, N-(3-methacrylamidopropyl)-N-benzyl-N,N-dimethylammonium chloride, or N-(3-methacrylamidopropyl-N,N,N-trimethylammonium chloride.

6. The imaging element of claim 1 wherein the crosslinking monomer comprises N,N'-methylenebisacrylamide, ethylene dimethacrylate, 2,2-dimethyl-1,3-propylene diacrylate, divinylbenzene, N,N'-bis(methacryloyl)urea, 4,4'-isoproylidenediphenylene diacrylate, 1,3-butylene diacrylate, 1,4-cyclohexylenedimethylene dimethacrylate, ethylene diacrylate, ethylidene diacrylate, 1,6-diacrylamidohexane, 1,6-hexamethylene diacrylate, 1,6-hexamethylene dimethacrylate, tetramethylene dimethacrylate, ethylenebis(oxyethylene)diacrylate, ethylenebis(oxyethylene)dimethacrylate, ethylidyne trimethacrylate or 2-crotonoyloxyethyl methacrylate.

7. The imaging element of claim 1, where the microgel particles have a Tg of greater than 20° C.

8. The imaging element of claim 1, wherein the antistatic layer further comprises a binder selected from the group consisting of water-soluble polymers, cellulose compounds, synthetic hydrophilic polymers, addition-type polymers prepared from ethylenically unsaturated monomers and interpolymers prepared from ethylenically unsaturated monomers.

9. The imaging element of claim 1, where the volume fraction of the electrically conductive particles is between 10% and 60%.

10. The imaging element of claim 1 comprises a silver halide imaging element.

* * * * *